United States Patent [19]

Shepard

[11] Patent Number: 5,040,573

[45] Date of Patent: Aug. 20, 1991

[54] WIRE LOOP FORMING APPARATUS AND METHOD

[75] Inventor: John S. Shepard, Fort Collins, Colo.

[73] Assignee: Inventions Unlimited, Inc., Fort Collins, Colo.

[21] Appl. No.: 584,600

[22] Filed: Sep. 19, 1990

[51] Int. Cl.[5] ..... B21F 1/06

[52] U.S. Cl. ..... 140/104

[58] Field of Search ..... 140/73, 102, 104

[56] References Cited

U.S. PATENT DOCUMENTS

| | | | |
|---|---|---|---|
| 740,444 | 10/1903 | Lamb et al. | 140/104 |
| 1,385,582 | 7/1921 | Parker | 140/102 |
| 2,242,341 | 5/1941 | Brignall . | |
| 2,550,130 | 4/1951 | Whaley . | |
| 2,683,306 | 7/1954 | Brignall . | |
| 3,195,583 | 7/1965 | Jones . | |
| 3,245,434 | 4/1966 | Collins et al. . | |
| 3,253,621 | 5/1966 | Hogan et al. . | |
| 3,342,223 | 9/1967 | Hall et al. . | |
| 3,665,583 | 5/1972 | Helderman . | |
| 3,847,189 | 11/1974 | Guzda . | |
| 4,091,845 | 5/1978 | Johnson . | |

*Primary Examiner*—Lowell A. Larson

*Attorney, Agent, or Firm*—Fields, Lewis, Pittenger & Rost

[57] ABSTRACT

Apparatus and method are disclosed for forming a loop in a wire that is particularly suited for attaching a wire to a ceiling suspension bracket and allow free swinging movement of the wire on the bracket. The apparatus includes a wire storage and feed bin, support for each wire during the loop forming, a twist member, a control head that moves the wire to form a bend, a drive that rotates the twist member through a selected number of revolutions to twist the bend to form the loop, coils and a tail in the wire. Surface portions of the control head confine the movement of the wire during the formation of the coils and loop. A control circuit for the drive motor causes the motor to turn only a selected number of revolutions to form a selected number of coils. A final positioning assembly causes the twist member to stop at the same position after each loop forming operation.

21 Claims, 4 Drawing Sheets

WIRE LOOP FORMING APPARATUS AND METHOD

TECHNICAL FIELD

This invention relates to a novel and improved apparatus and method for forming a loop in a wire that is particularly suited for attaching a ceiling hanger wire to a suspension bracket to suspend ceilings.

BACKGROUND ART

Hanger wires attached to suspension brackets have heretofore been provided to support suspended ceilings. A suspension bracket commonly in use is described in U.S. Pat. No. 3,665,583. In the past, wires have been attached to suspension brackets manually using hand tools wherein an end portion of a length of straight wire has been inserted through a hole in the suspension bracket and bent back on itself and a loop is formed by twisting the bent end portion to form a plurality of coils extending around the wire. Prior manual operations are generally slow and inefficient and have resulted in coils of non-uniform spacing, non-uniform coil diameters, non-uniform gaps between coils and tails of non-uniform lengths. Such non-uniformity is frequently unsatisfactory and in many cases will not meet the requirements of local building codes.

DISCLOSURE OF THE INVENTION

Apparatus and a method are disclosed for forming a loop in a wire that are particularly suited for attaching a ceiling hanger wire to a suspension bracket. The apparatus disclosed includes a wire storage and feed bin and a wire support for each wire. A twist member is located a selected distance from a free end of each supported wire. A control head is arranged to move an end portion of the wire against the twist member to form a bend in the wire and also serves to confine the movement of the wire during twisting to control the diameter of the coil, the spacing between coils and the position of the tail. A rotary drive motor via a rotary mount rotates the twist member about an axis of rotation substantially perpendicular to the longitudinal axis of the twist member and substantially midway between the ends of the twist member so as to form a loop, a series of coils and a tail in the wire. A control circuit causes the drive motor to automatically stop after a selected number of revolutions to regulate the number of coils formed. A final positioning assembly causes the twist member to return to the same position after forming a loop for the next operation. When the wire is first extended through a hole in a suspension bracket the wire becomes attached to the suspension bracket.

BRIEF DESCRIPTION OF THE DRAWINGS

Details of this invention are described in connection with the accompanying drawings in which like parts bear similar reference numerals and in which.

DETAILED DESCRIPTION

Figure 1:
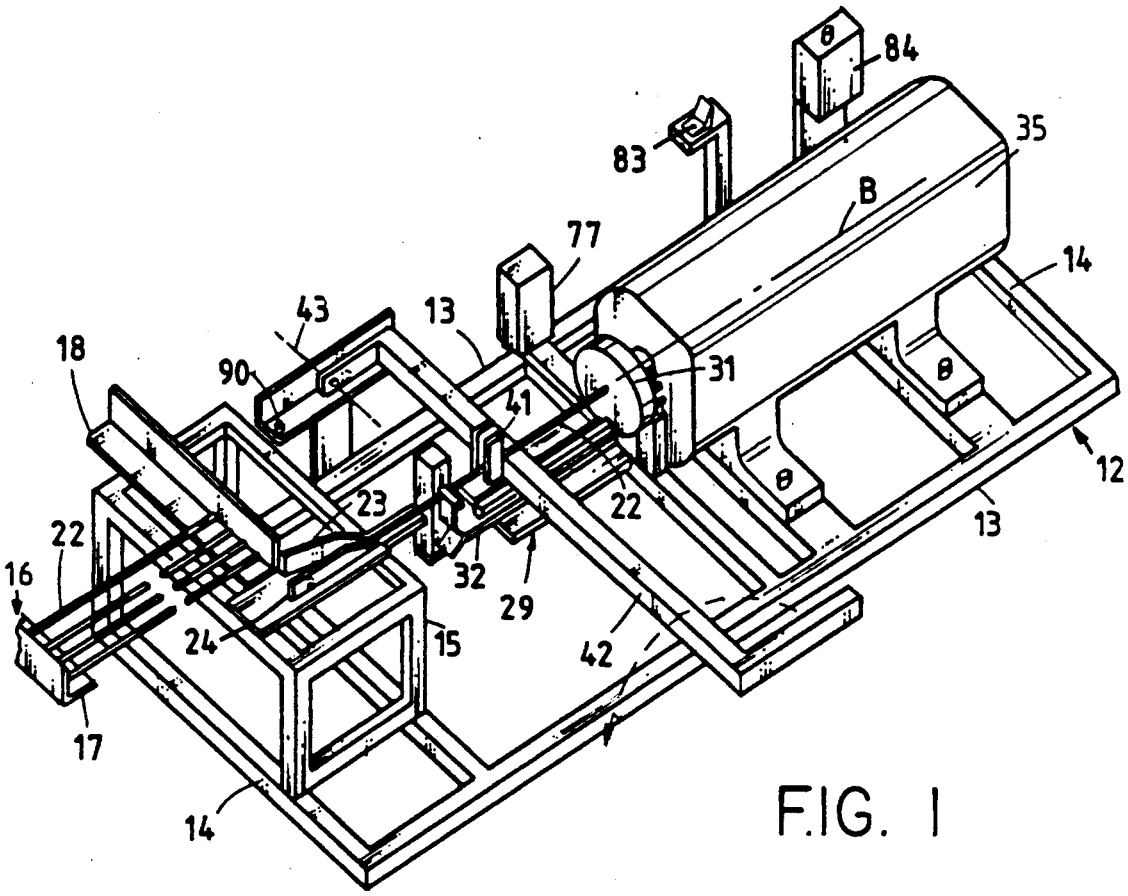
FIG. 1 is a top perspective view of wire forming apparatus with the control head in a first position.
Figure 2:
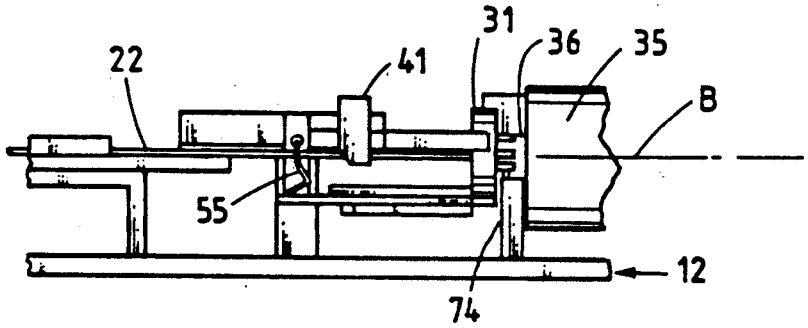
FIG. 2 is a front elevation view of a portion of FIG. 1.

Referring now to the drawings, there is shown wire forming apparatus embodying features of the present invention which includes a generally rectangular, horizontal support base 12 made of spaced front and rear tubular longitudinal members 13 and tubular transverse members 14 rigidly connected at the ends as by welding. A box-like raised base section 15 is mounted on base 12 at the feed end.

Figure 4:
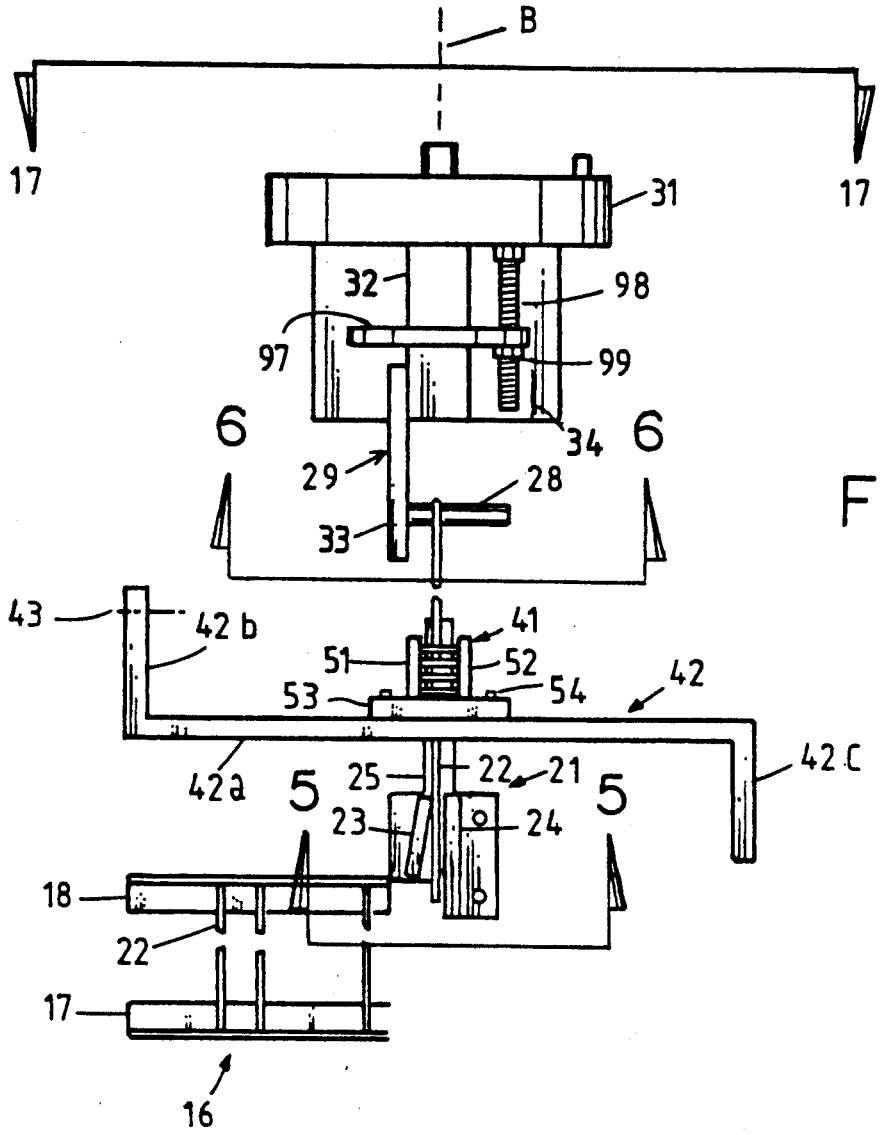
FIG. 4 is a top plan view of a portion of the apparatus shown in FIG. 1 with the control head in the second position and an adjustable stop for the wire added.
Figure 6:
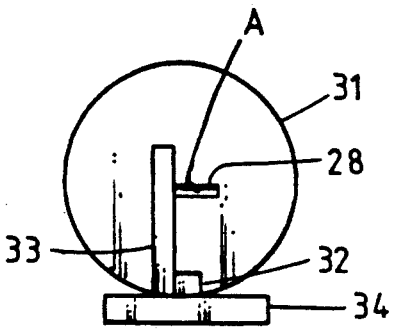
FIG. 6 is a sectional view taken along line 6—6 of FIG. 4.
Figure 5:
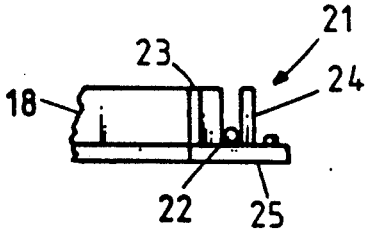
FIG. 5 is a sectional view taken along line 5—5 of FIG. 4.

At the feed end there is further provided a wire storage and feed bin 16 including a pair of facing right angle support members 17 and 18 on which a plurality of the wires are supported for slidable movement toward the front of the apparatus. A wire support 21 supports a single wire 22 during the loop forming operation. The wire support 21 includes an elongated flat base member 25 of rectangular cross section from which spaced upright left guide member 23 and right guide member 24 extend defining an elongated channel in which a portion of the length of the wire is supported. As best seen in FIG. 4 the right guide member 24 projects further to the left of the apparatus than the left guide member 23 and member 18 so the lead end of the wire will be first slid against right guide member 24 which serves as a temporary stop and aligning to the wire for slidable insertion into the wire support 21. The wire is then inserted into the wire support 21 for the loop forming operation. The left guide member 23 is inclined inwardly away from the feed end at the left side of the apparatus. The right guide member 24 has a base with bolt fasteners permitting lateral adjustment to accommodate for different wire diameters.

A twist member 28 in the form of an elongated cylindrical pin is mounted to be rotated about an axis A substantially perpendicular to the longitudinal axis of the twist member and substantially midway between the ends of the twist member 28.

A rotary mount 29 for the twist member 28 shown includes a cylindrical support 31, an offset axial arm 32, and an outer radial leg 33 parallel to and spaced from the support hub 31. The twist member 28 is attached to and extends perpendicular to the outer radial leg 33. An unbalanced weight member 34 is mounted along the axial arm 32 to cause the twist member to return to a lower at-rest position each time the motive power stops. The motive power for rotating the mount 29 and twist member 28 shown is an electric motor 35 supported at the end of the base 12 opposite the feed end with the motor 35 having a rotary drive shaft 36. The hub 21 is mounted on and affixed to the motor drive shaft 36 so that both rotate conjointly about an axis of rotation B. The rotational power from shaft 36 is transmitted radially out through the support hub 21, axially away from the motive power along axial arm 32, radially in along leg 33 and then to one end of the twist member 28.

Figure 7:
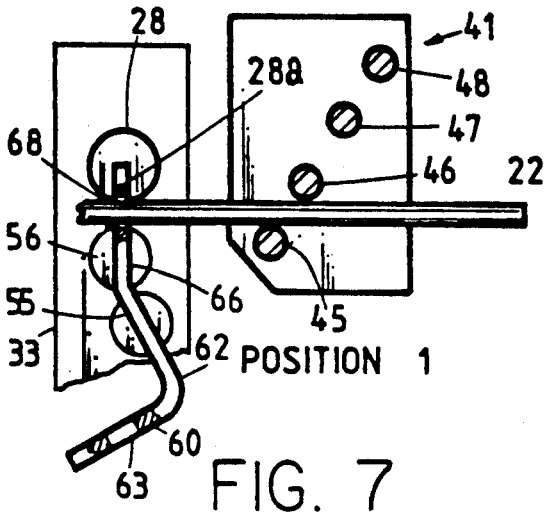
FIG. 7 is an enlarged front elevational view of a portion of FIG. 2 with the closest side plate removed.
Figure 8:
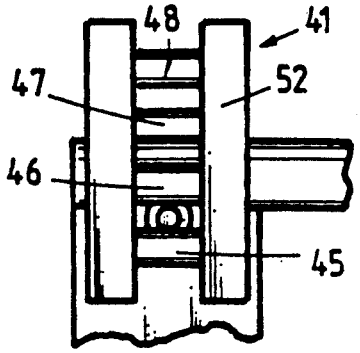
FIG. 8 is a right side elevational view of FIG. 7 with both side plates shown.
Figure 9:
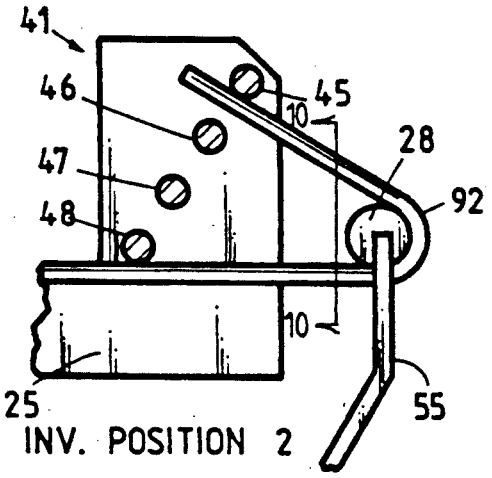
FIG. 9 is an enlarged front elevational view of a portion of FIG. 3 with the closest side plate removed.
Figure 10:
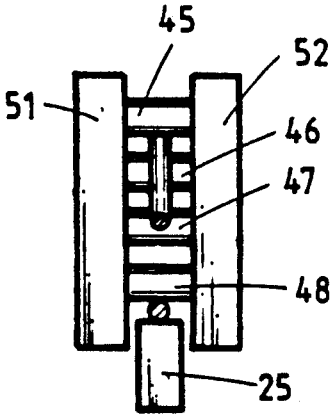
FIG. 10 is a sectional view taken along line 10—10 of FIG. 9 with both side plates shown.
Figure 11:
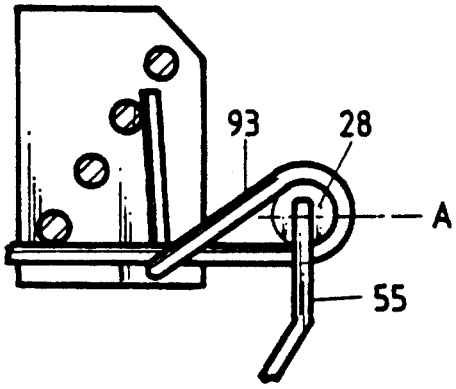
FIG. 11 is a front elevational view of the control head and wire after the first revolution with the closest side plate removed.
Figure 12:
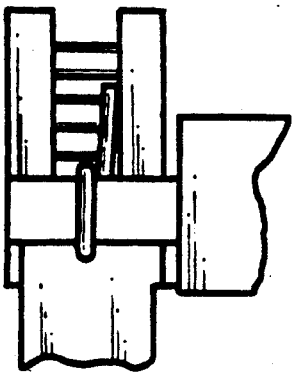
FIG. 12 is a right side elevational view of FIG. 11.
Figure 13:
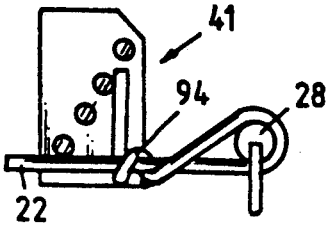
FIG. 13 is a front elevation view similar to FIG. 11 after the twist member has been rotated through the second revolution.
Figure 14:
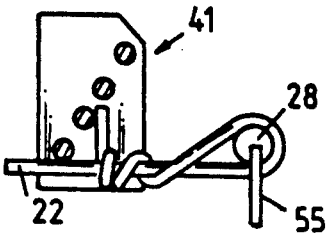
FIG. 14 is a front elevation view similar to FIG. 11 after the twist member has been rotated through a third revolution.
Figure 15:
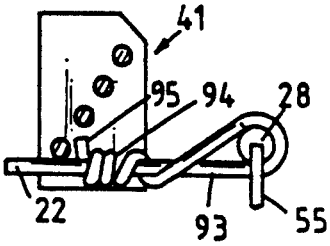
FIG. 15 is a front elevational view after the fourth revolution.
Figure 16:
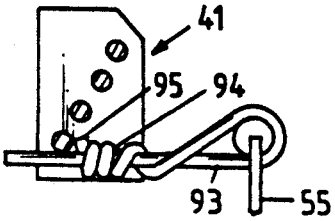
FIG. 16 is a front elevational view after the fifth revolution.

A control head 41 is mounted on a pivot arm assembly 42 that is arranged to pivot about a pivot axis 43 at the rear of the apparatus. The control head 41 in a first position (FIGS. 7 and 8) as viewed from the front and beginning at the bottom and proceeding up in the direction of the free end of the wire is between the twist member and the free end of the wire and has first, second, third and fourth pins 45, 46, 47 and 48, respectively, in spaced parallel relation supported by a pair of laterally spaced, parallel side plates 51 and 52 connected to a base 53 that is suitably fastened to the pivot arm as by bolts 54. As shown, the first pin 45 is closest to the supported end of the wire as measured along a line perpendicular to the wire and each succeeding pin is further away so the pins are centered along an upwardly inclined line. In the inverted position (FIG. 9) pin 45 is closest to the free end of the wire before bending as measured along a line perpendicular to the wire and at the highest elevation and pin 48 is furthest from the free end of the wire before bending as measured along a line perpendicular to the wire and at the lowest elevation. In the second position the pins are centered along a downwardly inclined line away from the loop so the successively lower pins engage the tail portion of the wire even though each successive coil increases the length of the coils along the wire to cause the coils to be in a close abutting relation as shown in FIGS. 13–16. The spacing of the parallel plates in relation to the diameter of the wire controls or determines the diameter or width of the coils and the size and location of the pins determines the spacing between coils and, in the embodiment shown, causes the coils to form in a close abutting relation.

Figure 3:
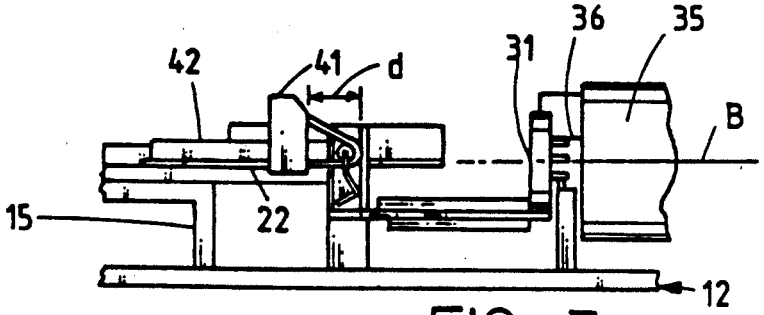
FIG. 3 is a front elevation of FIG. 2 with the control head in a second position.

The space between the side plates 51 and 52 is selected in relation to the diameter of the wire to confine or limit the lateral movement of each coil and tail during the formation thereof as the coil and tail will move against one side of one side plate as the twist member is rotated. The pins 45–48 limit or confine the vertical movement of the tail so as to keep the coils a selected distance apart and preferably a close abutting relation or tight coil and a tail of the same shape, position and configuration for each end product. The distance designated "d" in FIG. 3 between the twist member and the control head is selected to provide a selected length of formed loop. The diameter of the twist member determines the width of the loop. The length and width (size) of the loop must be sufficiently large to enable the wire loop to swing freely with respect to the bracket when the wire loop is suspended from the bracket and the bracket is fastened to an overhead support surface, such as the ceiling. Typically the apparatus will form a loop in a #9 wire or a #12 wire. A different sized control head 41 with different pin locations and sizes and a different sized base section 25 is readily removed and replaced for different wire sizes.

The pivot arm assembly 42 which serves as an actuator means for moving the control head 41 includes a straight main section **42*a* extending front to rear of the apparatus, a transverse rear end section 42*b* and a transverse front handle section 42*c*. The pivot axis 43 extends through rear end section 42*b*. The width of the parallel sides of the base section 25 (rectangular) is slightly narrower than the spacing between the plates 51 and 52 and in the second position the pin 48 presses the wire down against the base section and the side plates overlap and straddle the sides of the base section 25**.

The apparatus disclosed herein is particularly suited for using the formed loop to attach a wire to a suspension bracket but it is understood the loop may be formed in the wire without first passing it through the hole in a bracket for other purposes.

When the apparatus is used to attach the wire to a suspension bracket, a lower end portion of a suspension bracket 55 is slidably received in a longitudinal slot **28*a* in the bottom of the twist member 28. The suspension bracket 55 is shown releasably held to the front face of leg 33 by a pair of permanent magnets 56 on leg 33. The suspension bracket 55 shown includes an attaching flange portion with an end leg 60 and a side leg 62 at right angles to leg 60. An opening 63 in leg 60 permits the bracket to be fastened to the ceiling as with a powder-actuated pin or the like that extends through opening 63 and into the ceiling. In this arrangement, end leg 60 butts against the ceiling and leg 62 depends downwardly therefrom. An inclined leg 66 extends angularly from the extending end of the side leg 62. The inclined leg 66 has an opening 68 formed therein through which the wire 22** is shown as extending for a selected distance. It is understood that other bracket shapes may be used such as, for example, a bracket having a right angle shape with holes in both legs.

An adjustable stop assembly for the wire shown only in FIG. 4 includes a transverse stop plate 97 on an externally threaded member 98 extending into the support hub and a locking nut 99 to set the stop plate at a selected position. The free end of the wire butts against the stop plate and the position of the stop plate along member 99 determines the number of coils formed in the end of the wire for a selected number of rotations of the twist member.

Figure 17:
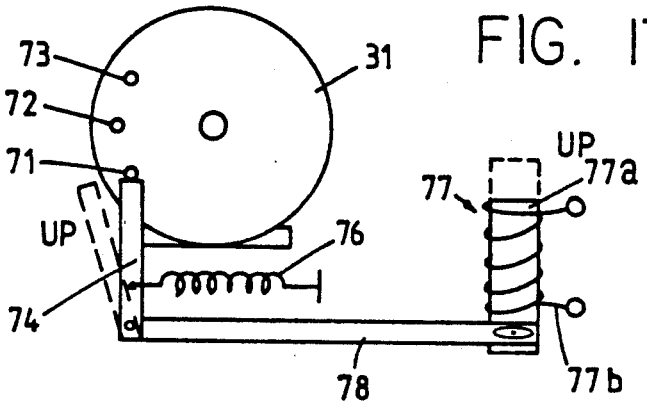
FIG. 17 is a sectional view along lines 17—17 of FIG. 4 with the solenoid, linkage, spring and pivot arm added and shown schematically.

A final positioning assembly is best seen in FIG. 17. Three circumferentially spaced axial pins 71, 72 and 73 are mounted on the back side of the support hub 31. An upright stop arm 74 pivots at a lower end about a pivot axis 75 to move between a release position and a stop position. A link 78 between the lower end of the armature and the lower end of the pivot arm translates the motion of a solenoid armature **72*a* to pivot the pivot arm. A spring 76 between the pivot arm and a fixed position moves the pivot arm to the stop position. The solenoid 77 has the solenoid armature 77*a* normally down and a solenoid coil 77*b* which moves the armature up when energized. When the solenoid is energized the hub 31 is released for free rotation. When the coil is deenergized the spring 76** moves the arm to the up position and permits the pin to come against the top of the arm to stop the hub at a final position awaiting the next wire loop forming operation.

Figure 18:
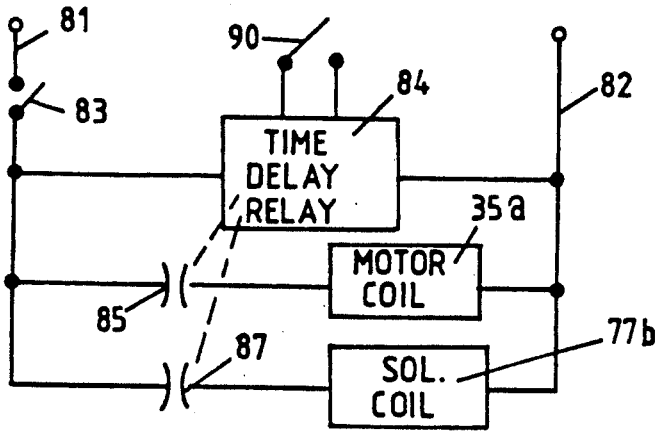
FIG. 18 is a schematic circuit diagram of the control circuit for the drive motor.

The control circuit for the electric motor 76 shown in a schematic diagram in FIG. 18 includes a pair of electric power lines 81 and 82 supplied by suitable electric power and an on-off power switch 83. Coils (not shown) of the time delay relay 84 are connected across the power lines when the switch 83 is closed. Also connected across the power lines is a series circuit with a normally-open contact 85 of relay 84 in series with a motor coil 86*a* and a second series circuit with a normally-open contact 87 of relay 84 in series with a solenoid coil 77*a*. An electric switch 90 connected to the time delay relay is closed by moving the pivot arm assembly 42 to the second position, the motor 35 will run so as to rotate a selected number of rotations (5) and deactivation of the coils of the relay 84 causes the contacts 85 and 87 to open and the motor 86 to stop and the solenoid armature 77*a* to move to a down position causing the hub to stop in the final position as above described.

In the wire loop forming operation, initially, a wire 22 is slid out of the bin and against guide member 24 to align the wire with the wire support 21. The wire is then inserted into support 21, passed through the hole in the bracket which is in the slot of the twist member, then between the first and second pins 45 and 46 and then the free end butts against stop plate 97. The control head 41 is moved between a first position shown in FIGS. 1, 2, 7 and 8 and a second position in FIGS. 3, 4, 9 and 10 on the opposite side of the twist member by pivoting the arm assembly 42 about pivot axis 43 whereby the pins 45 and 46 are inverted to bend the wire back over itself to form a bend 92 in the wire and switch 90 is closed. The closure of switch 90 causes the motor to run which, in turn, causes the twist member 28 to rotate about the axis of rotation A. The twist member rotates through a selected number of revolutions (5 disclosed herein) to form a closed loop 93, a series of coils 94 and a tail 95 in the wire and at the same time attaches the wire to the bracket. During the rotation, the side plates are spaced apart a selected distance to confine the extent of lateral movement of the coils and tail during formation thereof to minimize the diameter of the coils. The pins further limit the vertical extent of the tail by having the end portion of the wire successively coming into contact with pins 45, 46, 47, and 48, respectively, as seen in FIGS. 11–16, which pins push against the wire causing the coils to form in a close abutting relation. The tail is in the same final position each time. It is understood a stepping motor or a brake motor may be used in place of the above described final positioning mechanism to locate the twist member in a selected angular position at the end of each forming operation.

By way of illustration and not limitation a relay 84 found suitable for this invention is a time delay relay-on delay 0.1 to 10 seconds, Model No. 5X828F manufactured by Dayton. The knob and associated scale on the top of the device shown in FIG. 1 is used to set the time delay. A typical time for five revolutions is about 2 seconds.

Although the present invention has been described with a certain degree of particularity, it is understood that the present disclosure has been made by way of example and that changes in details of structure may be made without departing from the spirit thereof.

What is claimed is:

1. Apparatus for forming a loop in the end of a wire comprising:

support means for a wire having a free end portion extending beyond said support means and terminating in a free end, a twist member adjacent said wire disposed a selected distance from said free end along said wire, control head means for moving said wire against said twist member to form a bend in said wire, means to rotate said twist member about an axis of rotation substantially perpendicular to the longitudinal axis of said twist member and substantially midway between the ends of said twist member so as to form a loop in said free end portion, a series of coils and a tail, said control head means having surface portions confining the extent of lateral movement of said coils during formation and the lateral and vertical movement of said tail as said twist member is rotated to control the size and shape of said coils, the spacing between coils and the position of said tail.

2. Apparatus as set forth in claim 1 including a wire storage and feed bin adjacent said support means on which a plurality of wires are supported for sliding movement toward said support means.

3. Apparatus as set forth in claim 1 wherein said support means includes an elongated flat base on which said wire is supported for a selected distance along the length thereof and a pair of spaced upright guide members extending up from the opposite sides of said wire.

4. Apparatus as set forth in claim 3 wherein one of said upright guide members extends beyond the other in the direction the wire is fed into said support means to form a temporary stop for an end portion of each wire and aligns the wire for slidable insertion into said support means.

5. Apparatus as set forth in claim 1 wherein said twist member is in the form of a cylindrical pin supported at one end on a rotary mount, said rotary movement including a support hub for transmitting rotary power in a radially out direction, an offset axial arm spaced from and extending parallel to the axis of said hub for transmitting power in an axial direction, and an outer radial leg opposite and spaced from said hub for transmitting power in a radial direction, said twist member being attached to said outer radial leg and extending perpendicular thereto.

6. Apparatus as set forth in claim 5 including a weight member mounted along the outside of said axial arm to further cause the twist member to return to the same position after rotary power is removed from said support hub.

7. Apparatus as set forth in claim 1 wherein said control head means includes a pair of parallel spaced first and second pins between which said free end portion of said wire extends, said pins being supported at the ends by a pair of parallel spaced side plates disposed a selected distance apart, and actuator means for said control head means to move said pins and side plates from a first position on one side of said twist member between said twist member and the free end of said wire to an inverted second position on the opposite side of said twist member to effect said bend.

8. Apparatus as set forth in claim 7 wherein said actuator means includes a pivot arm having a first arm portion transverse to a pivot axis and a second arm portion parallel to said pivot axis, said control head means being carried by said second arm portion whereby the pivoting of said pivot arm about said pivot axis inverts said control head means.

9. Apparatus as set forth in claim 7 wherein said control head means includes a third pin and a fourth pin at successively lower elevations and successively further away from said twist member than said first and second pins in said second position against which said tail moves during the rotation of said twist member to cause the coils to form in a close abutting relation, said third and fourth pins being spaced from and parallel to on another and parallel to and spaced from said first and second pins.

10. Apparatus as set forth in claim 9 wherein said support means includes a base section having parallel spaced sides a selected distance apart, said side plates being spaced to slide over and straddle said base section in said second position with said fourth pin holding said wire down against the top of said base section during the rotation of said twist member.

11. Apparatus as set forth in claim 1 wherein said means to rotate includes a drive motor having a rotary drive shaft that rotates said twist member via a rotary mount including a rotary support hub mounted to said shaft.

12. Apparatus as set forth in claim 11 including control means for selectively actuating said motor, said motor being actuated when an actuator means supporting said control head means moves from a first position to a second position, said motor being automatically deactuated by said control means after a selected time interval to rotate said twist member a selected number of revolutions.

13. Apparatus as set forth in claim 12 including final positioning means to stop said rotary hub at a selected angular position after the power to the motor is removed.

14. Apparatus as set forth in claim 13 wherein said final positioning means includes at least one stop pin extending axially out from said support hub; a pivot arm pivoted about a pivot axis having an end engaged by said pivot arm and an electric actuator operated by said control means to move said pivot arm to one position when said motor is running and a second position when said motor is stopped.

15. Apparatus as set forth in claim 14 wherein said electric actuator is an electromagnet coupled by a linkage to pivot said pivot arm with said pivot arm being moved against the biasing action of a spring.

16. Apparatus for attaching a hanger wire to a suspension bracket and the like comprising:

support means for a substantially straight length of wire extending through a hole in a suspension bracket, said wire having a free end portion terminating in a free end, a twist member adjacent said wire disposed a selected distance from said free end, control head means including a pair of spaced first and second pins between said twist member and the free end of said wire between which said wire extends in a first position, said control head means being movable to a second position on the opposite side of said twist member to bend said free end portion back over said twist member to form a bend in said wire, means to rotate said twist member about an axis of rotation substantially perpendicular to the longitudinal axis of said twist member and substantially midway between the ends of said twist member a preselected number of turns to produce a loop and a series of coils and a tail, said control head means having side plates for confining the lateral movement of said loop and coils and lateral and vertical movement of said tail as said bend member is rotated to control the size and shape of the coils, the spacing between coils and the position of said tail and to attach said wire to said suspension bracket.

17. Apparatus as set forth in claim 16 wherein said twist member is in the form of a cylindrical pin on a rotary mount, said pin having a longitudinal slot into which an end of said bracket is slidably received to hold said bracket to said pin during the forming of said loop.

18. Apparatus as set forth in claim 17 including means to releasably fasten said bracket to said rotary mount during the forming of said loop.

19. Apparatus as set forth in claim 16 wherein the spacing between said control head means and said twist member in said second position and the diameter of said twist member are selected to establish the size of the loop formed in said coil to enable said loop to slide freely in said bracket when said bracket is fastened to an overhead support surface.

20. A method of forming a loop in the end of a wire comprising the steps of:

supporting an end portion of a length of wire adjacent a twist member a preselected distance from a free end of said wire with said wire being free to rotate about its longitudinal axis, moving said end portion of said wire against said twist member to form a bend in said wire to provide a supported wire portion extending in one direction from said bend with said end portion extending in the opposite direction from said bend, and rotating said twist member about an axis of rotation substantially perpendicular to the longitudinal axis of said twist member and substantially midway between the ends of said twist member a selected number of revolutions to wrap said end portion about said supported wire portion and rotate said supported wire portion about its longitudinal axis to form a loop with a selected number of coils terminating in a tail, and while rotating said twist member, confining the extent of lateral movement of said loop and coils and the lateral and vertical movement of said tail as said twist member is rotated to control the size and shaped of said coils, provide a close-abutting relation between coils and control the position of said tail.

21. A method of attaching a hanger wire to a suspension bracket comprising the steps of:

supporting an end portion of a substantially straight length of wire adjacent a twist member a preselected distance from a free end of said wire with said wire extending through a hole in a suspension bracket with said wire being free to rotate about its longitudinal axis.

moving said end portion of said wire against said twist member to form a bend in said wire to provide a supported wire portion extending in one direction from said bend with said end portion extending in the opposite direction from said bend, and rotating said twist member about an axis of rotation substantially perpendicular to the longitudinal axis of said twist member and substantially midway between the ends of said twist member a selected number of revolutions to wrap said end portion about said supported wire portion and rotate said supported wire portion about its longitudinal axis to form a loop of a selected size in relation to the size of said bracket so said loop will slide freely in relation to said bracket with a selected number of coils terminating in a tail, and while rotating said twist member, confining the extent of lateral movement of said loop and coils and the lateral and vertical movement of said tail as said twist member is rotated to control the size and shape of said coils to provide a close abutting relation between coils and control the position of said tail.

* * * * *